US008421698B2

(12) United States Patent
Neto et al.

(10) Patent No.: US 8,421,698 B2
(45) Date of Patent: Apr. 16, 2013

(54) LEAKY WAVE ANTENNA USING WAVES PROPAGATING BETWEEN PARALLEL SURFACES

(75) Inventors: Andrea Neto, Voorburg (NL); Mauro Ettorre, Rennes (FR); Giampiero Gerini, Den Haag (NL)

(73) Assignee: Nederlandse Organisatie voor toegepastnatuurwetenschappelijk onderzoek TNO, Delft (NL)

( * ) Notice: Subject to any disclaimer, the term of this patent is extended or adjusted under 35 U.S.C. 154(b) by 326 days.

(21) Appl. No.: 12/669,982

(22) PCT Filed: Jul. 25, 2008

(86) PCT No.: PCT/NL2008/050513

§ 371 (c)(1),
(2), (4) Date: Mar. 17, 2010

(87) PCT Pub. No.: WO2009/014446

PCT Pub. Date: Jan. 29, 2009

(65) Prior Publication Data

US 2010/0194656 A1 Aug. 5, 2010

(30) Foreign Application Priority Data

Jul. 25, 2007 (EP) ..... 07113133

(51) Int. Cl.
*H01Q 13/10* (2006.01)

(52) U.S. Cl.
USPC ..... 343/771; 343/770

(58) Field of Classification Search ..... 343/770, 343/771; 333/157, 159, 239, 248
See application file for complete search history.

(56) References Cited

U.S. PATENT DOCUMENTS

| | | | | |
|---|---|---|---|---|
| 5,173,714 | A * | 12/1992 | Arimura et al. | 343/771 |
| 5,745,083 | A * | 4/1998 | Uematsu et al. | 343/771 |
| 7,023,393 | B2 * | 4/2006 | Ishii et al. | 343/771 |
| 7,142,165 | B2 * | 11/2006 | Sanchez et al. | 343/771 |

FOREIGN PATENT DOCUMENTS

| | | | |
|---|---|---|---|
| EP | 0 329 079 | A2 | 8/1989 |
| GB | 2 221 800 | A | 2/1990 |
| WO | WO 91/17586 | A1 | 11/1991 |

OTHER PUBLICATIONS

"Single-Layer Feed Waveguide Consisting of Posts for Plane TEM Wave Excitation in Parallel Plates", Jiro Hirokawa et al., IEEE Transactions on Antennas and Propagation, vol. 46, No. 5, pp. 625-630, May 1, 1998.

"Post-Wall Waveguide Slot Array With a Three-Way Power Divider on a Single-Layer Dielectric Substrate", Shin-ichi Yamamoto et al., IEICE Transaction on Communication Communications Society, Tokyo, JP, vol. E88-B, No. 4, pp. 1740-1742, Apr. 1, 2005.

(Continued)

*Primary Examiner* — Hoang V Nguyen
(74) *Attorney, Agent, or Firm* — Dorsey & Whitney LLP

(57) ABSTRACT

A leaky wave antenna has electrically conductive surfaces in parallel to each other. At one place a two-dimensional array of slots is provided in one of the surfaces. Elsewhere a feed structure is realized comprising one or more electrically conductive elements coupled between the first and second electrically conductive surface and configured to direct an electromagnetic wave pattern travelling between surfaces towards the array. In an embodiment the feed structure comprises a waveguide formed between walls connecting the surfaces. One of the walls is made to leak in order to feed the array of slots. In an embodiment the feed structure comprises a reflector comprising connections between the surfaces, to direct waves between the surfaces to the array of slots.

21 Claims, 3 Drawing Sheets

OTHER PUBLICATIONS

"45° linearly polarised post-wall waveguide-fed parallel-plate slot arrays", J. Hirokawa et al., IEE Proceedings H. Microwaves, Antennas & Propagation, Institution of Electrical Engineers, Stevenage, GB, vol. 147, No. 6, pp. 515-519, Dec. 6, 2000.

"Substrate Integrated Waveguide Leaky-Wave Antenna: Concept and Design Considerations", Dominic Deslandes et al., Microwave Conference Proceedings, 2005, APMC 2005. Asia-Pacific Conference Proceedings Suzhou, China, Piscataway, NJ, USA, IEE, vol. 1, pp. 1-4, Dec. 4, 2005.

"A Coaxial Line to Post-Wall Waveguide Transition for a Cost-Effective Transformer between a RF-Device and a Planar Slot-Array Antenna in 60-GHz Band", Takafumi et al., IEICE Transactions on Communications, Communications Society, Tokyo, JP, vol. E89-B, No. 5, pp. 1646-1653, May 1, 2006.

* cited by examiner

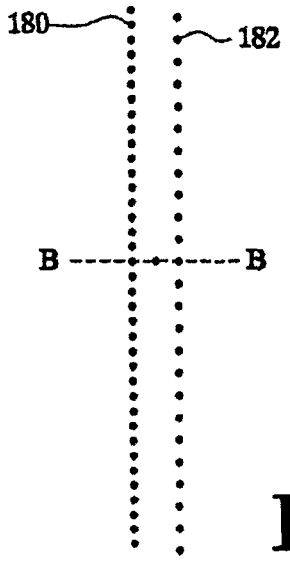
Fig.2a
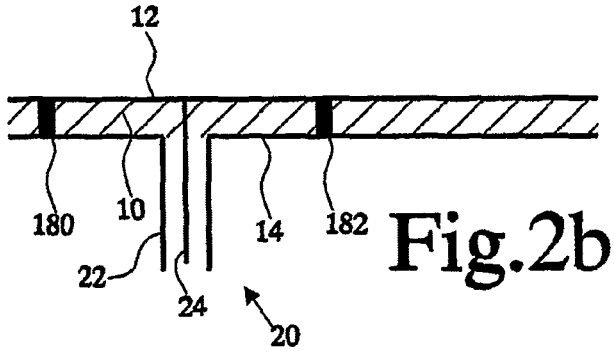
Fig.2b
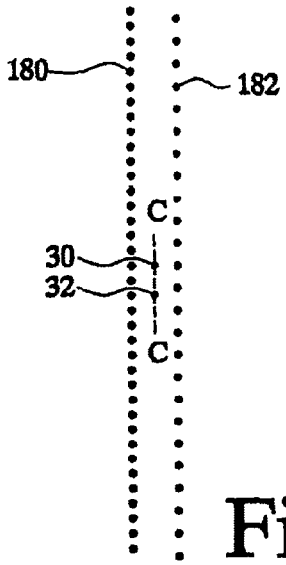
Fig.3a
Fig.3b
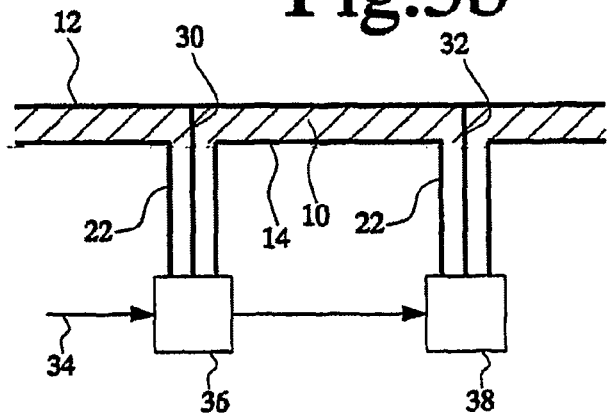

LEAKY WAVE ANTENNA USING WAVES PROPAGATING BETWEEN PARALLEL SURFACES

CROSS-REFERENCE TO RELATED APPLICATIONS

This application is the national stage application of PCT Patent Application No. PCT/NL2008/050513, filed Jul. 25, 2008 and entitled "Leaky Wave Antenna Using Waves Propagating Between Parallel Surfaces", which claims priority under 35 U.S.C. §365(b) to European Patent Application No. 07113133.8 filed Jul. 25, 2007 and entitled "Leaky Wave Antenna Using Waves Propagating Between Parallel Surfaces".

FIELD OF THE INVENTION

The invention relates to a leaky wave antenna with a slot array, comprising a first and second electrically conductive surface in parallel with each other, with a two dimensional array of slots in the first surface and a feed structure for exciting and/or receiving electromagnetic waves that travel between the first and second surface.

BACKGROUND

An antenna with parallel electrically conductive surfaces is described in an article titled "A Metallic Fabry—Perot Directive Antenna" by Nicolas Guerin et al. and published in the IEEE transactions on antennas and propagation Vol 54 No. 1 (2006), pages 220-224. In one surface a two dimensional array of slots is provided. The slots have the effect that an electromagnetic waves pattern between the surfaces leaks out through the slots. This results in a directional antenna pattern. The term "slots" is used here because it is conventional. As used herein, the term "slots" refers to openings of any shape through a surface.

Among others, the main lobe of the directional antenna depends on the two-dimensional wave pattern between the surfaces. This pattern is determined by the feed structure. Due to reciprocity a feed structure may be used for transmission and reception. As used herein, the term feed structure refers to either one or both of transmission and reception, although its operation will be described in terms of transmission.

The article by Guerin et al uses a patch antenna as a feed structure, with a square patch of electrically conductive material located between the surfaces, near the second surface and at the centre of the two dimensional array. Unfortunately, this feed structure allows only for a limited number of antenna patterns. Furthermore, positioning of the patch complicates manufacture antenna. Guerein et al describe that foam may be injected between the surfaces, but it would be desirable to use surfaces on mutually opposite sides of a dielectric sheet. In this case multiple sheets would be needed to realize a patch between the surfaces. Moreover, to realize sharp lobes it is desirable to use a feed structure that produces narrowly directed waves between the surfaces. Also, to realize lobes in different directions it is desirable to use a feed structure that is capable of producing a plurality of narrowly directed waves between the surfaces.

SUMMARY

Among others it is an object to provide an antenna with a first and second electrically conductive surface in parallel, and with a two dimensional array of slots in the first surface, wherein a feed structure is provided that improves the use of the antenna.

A leaky wave antenna according to claim 1 is provided. Herein the feed structure for feeding waves to a region of the array of slots between the conductive surfaces (or receiving waves from said region) comprises one or more electrically conductive elements coupled between the first and second conductive surface. The electrically conductive elements may for example comprise a series of electrically conductive pillars, connecting the surfaces and located spaced apart from each other to form a wall that reflects waves, such as a wall of a waveguide or a reflector. Instead of a wall made of pillars a continuous wall may be used.

In an embodiment a feed structure of the antenna comprises a waveguide structure comprising a first and second, at least partially conductive wall in parallel with each other, the second wall having openings for allowing leaky wave coupling between a wave that travels through the waveguide and waves travelling to or from a direction of radiation to the regions of the array of slots. Herein the direction of radiation to the regions of the array of slots may be the direct geometric direction of the array of slots, or a direction that leads to the regions via one or more reflectors, whichever is taken to couple radiation to or from the array of slots. The second wall may comprise a series of conductive pillars arranged along a trajectory of the wall.

In a further embodiment feed pillar, is provided in the waveguide. located between the walls and extending in a direction between the first and second surface, electrically connected to one of the first and second surface and to an input and/or output terminal of the antenna. A plurality of conductive feed pillars may used in the waveguide. This can be used to supply versions of a transmission signal with respective phase delays to the feed pillars, the phase delays corresponding to waveguide phase delays of waves travelling through the wave guide. Thus excitation of undesirable modes in the waveguide may be reduced. Multiple feed pillars can also be used to excite local waves at different positions along the waveguide. In an embodiment this may be used to realize different source points for a focussing reflector.

In an embodiment the feed structure comprises a reflector comprising a curved wall electrically coupling the first conductive surface to the second conductive surface. The curved wall may have a parabolic trajectory for example. The curved wall may comprise a series of conductive pillars arranged along a trajectory of the curved wall.

In an embodiment the frequency of the carriers may be selected dependent on a required antenna pattern direction. In an embodiment a plurality of mutually different frequencies, may be used concurrently to realize beams in a plurality of directions.

BRIEF DESCRIPTION OF THE DRAWING

Figure 1A:
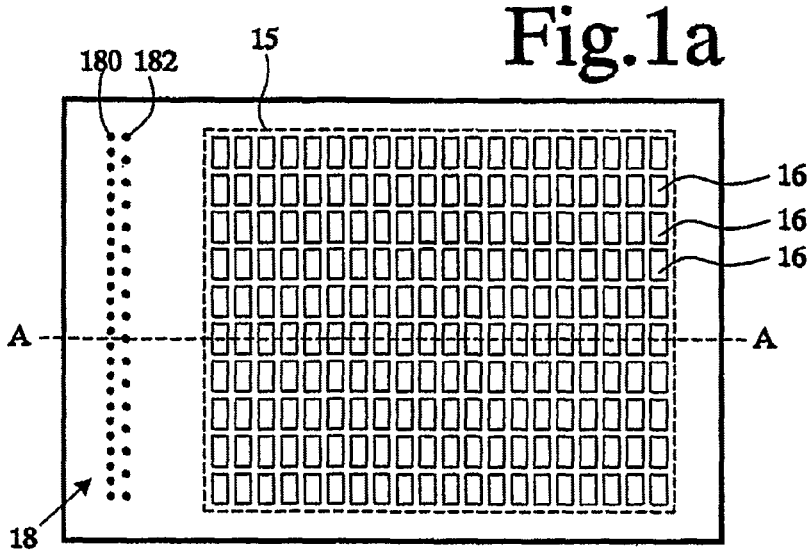
FIG. 1*a-c* show an antenna with an array of slots FIGS. 2*a, b* show a cable connection to the feed structure FIGS. 3*a, b* show an alternative feed structure
Figure 1B:
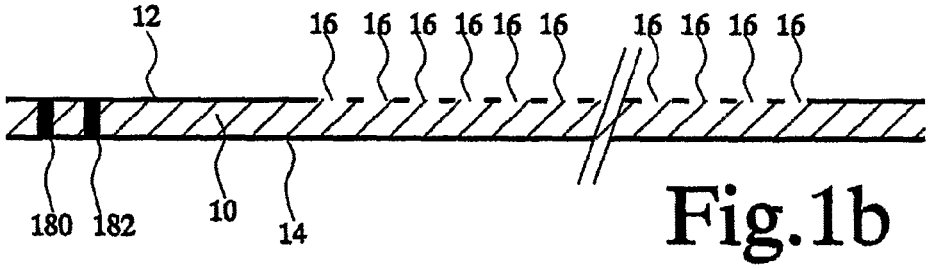

These and other objects and advantageous aspects will become apparent from a description of exemplary embodiments, using the following figures FIG. 1*a* shows a top view of an antenna with an array of slots. FIG. 1*b* shows a side view in cross-section along dashed line A-A of FIG. 1*a*. It should be noted that the size of slots 16 and the number of rows and columns in the array 15 is merely shown symbolically in the figure. In practice far more and smaller slots may be used. The antenna comprises a dielectric sheet 10, and a first conductive surface 12 and a second conductive surface 14, attached to respective sides of sheet 10. Slots 16 are present, which extend through first conductive surface 12. As can be seen in FIG. 1*a*, slots 16 (only a few explicitly labelled) form a two dimensional array 15 (indicated by a dashed line for the sake of illustration), wherein the slots are arranged in rows and columns. By way of example, the rows and columns are shown perpendicular to each other, with one slot in each cell at an intersection of rows and columns, but non-perpendicular rows and columns and cells with multiple slots may be used as well, e.g. in a hexagonal structure. Also, although an embodiment has been shown with slots that are each completely separated from other slots, alternatively slots of different cells in the array may be in contact with each other. For example, the array of slots may comprise repeating islands of conductive surface 12, surrounded by open areas. The term "array of slots" as used herein requires a pattern of areas where conductive surface 12 is present and not present respectively and that repeats in two directions.

At the side of the array 15 of slots 16 a feed structure 18 is provided, comprising a first row of conductive pillars 180 and a second row of conductive pillars 182, parallel to the first row of pillars 180 and between the first row of pillars 180 and the array 15 of slots 16. It should be appreciated that the diameter of the pillars 180, 182 and their distance has been exaggerated in the figure. In practice a greater number of smaller pillars may be used. The pillars 180, 182 of both rows extend through dielectric sheet 10 and electrically connect the first and second conductive surfaces 12, 14, which contain no slots between the first and second row of pillars. Effectively, the conductive surfaces and the rows of pillars form a rectangular waveguide with rows of pillars as walls.

First row of pillars 180 has a first spacing between successive pillars in the first row. Second row of pillars 180 has a second spacing between successive pillars in the second row. The second spacing is larger than the first spacing. The second spacing is selected so large that at wavelengths used during operation much more radiation leaks from the waveguide between the pillars of the second row than between the pillars of the first row. The first spacing is selected so small that at these wavelengths effectively no radiation occurs through the first row, e.g. less than ten percent of the radiation that leaks through the second row. Although an embodiment is shown with cylindrical pillars with circular cross-section, it should be realized that differently shaped pillars may be used, such as cylinders with elliptical cross section etc.

In transmission operation electromagnetic wave is excited in the waveguide formed by conductive surfaces 12, 14 and the rows of pillars. The wave leaks out through the second row of pillars 182, creating a travelling wave pattern between conductive surfaces 12, 14 adjacent the array 15 of slots 16. Because a leaking wave is used the travelling waves approximate plane waves of a single direction of propagation, wherein the points with equal phase form approximately straight lines parallel to conductive surfaces 12, 14. The waves adjacent the array 15 of slots 16 in turn leak through the array 15 of slots 16 into space outside the antenna, creating a directional far field pattern.

Reciprocally, the antenna may be used for reception, using incoming waves to excite waves between the conductive surfaces 12, 14 in the array 15 of slots 16, with a propagation direction dependent on the angle of incidence. The second row of pillars 182 allows waves with selected direction to enter the waveguide formed by the conductive surfaces and the rows of pillars. Thus the antenna can be used for transmission or reception or both. As the operation during reception reciprocally corresponds to operation during transmission, only transmission will be described in the following.

As may be noted the feed structure manufacture of the feed structure is compatible with that of the remainder of the antenna. manufacturing may start from a dielectric sheet 10 with continuous conductive surfaces 12, 14. Slots 16 may be realized by etching through first conductive surface 14 at photolithographically defined positions. Pillars 180, 182 may be realized as vias between the conductive surfaces 12, 14, e.g. by drilling or etching followed by filling with conductive material. Thus, conventional printed circuit board manufacturing technology may be used to manufacture the antenna as a printed circuit board. Generator and/or receiver circuits may be placed on this printed circuit board as well.

Furthermore it may be noted that the feed structure makes it possible to produce a highly directive antenna pattern because it produces a wave pattern with a narrow range of wave directions. The direction is determined by the propagation properties of the waveguide formed by conductive surfaces 12, 14 and the rows of pillars. The rows of pillars 180, 182 may be placed at any angle relative to the array 15 of slots 16 to realize a desired wave direction.

In a further embodiment a multibeam antenna is realized by using a plurality of pairs of rows of pillars, each in a different direction from the array 15 of slots 16. Each pair of rows may have a respective orientation and/or wave propagation properties to define a respective plane wave direction for creating a respective beam.

Instead of a feed structure with rows of pillars 180, 182 in straight lines, curved lines of pillars may be used. This may be used to create a focussing effect on the transmitted waves. Furthermore, although an embodiment is shown wherein the feed structure is located outside the array 15, in order to produce waves that travel throughout the array, it should be appreciated that alternatively the rows of pillars may be provided inside the array. In this case, the pillars in both rows may be spaced to leak waves, to respective parts of the array. In another embodiment arrays of slots are provide on both sides of the rows of pillars. In this case, the pillars in both rows may be spaced to leak waves, to respective arrays.

Figure 1C:
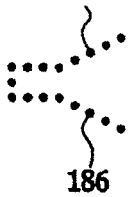

FIG. 1*c* shows rows of pillars 184, 186 that that diverge at least partly to form a horn-like structure directed at the array 15 of slots. Herein the spacing between the pillars in both rows may be so small that effectively no radiation leaks except through the opening of the horn, e.g. less than ten percent of the radiation that escapes through the second horn. However, use of parallel rows has the advantage that a smaller area suffices to create a substantially planar wave.

FIGS. 2*a, b* shows a cable connection to the feed structure. FIG. 2*a* shows a top view and FIG. 2*b* shows a cross-section along dashed line B-B of FIG. 2*a*. A coaxial cable 20 is used, with an outer conductor 22 electrically coupled to second conductive surface 14 and an inner conductor 24 running through sheet 10 to first surface 12. Effectively, inner conductor 24 forms a further pillar between the first and second row of pillars.

In transmission operation, a signal is applied to coaxial cable 20. As a result an electromagnetic wave is excited in the waveguide formed by conductive surfaces 12, 14 and the rows of pillars. As described this wave ultimately leads to a directional far field pattern.

As will be appreciated coaxial cable 20 can easily be connected, for example by drilling a hole through sheet 10 and conductive surfaces 12 for the inner conductor 24.

Instead of this type coaxial feed other feeds, such as an aperture in one of the conductive surfaces 12, 14 between the rows of pillars 180, 182 may be used, to which a waveguide may be coupled.

FIGS. 3*a, b* show an alternative feed structure (in top view and in cross-section through the line C-C) wherein a plurality of conductive feed pillars 30, 32 is used between the rows of pillars 180, 182. The feed pillars are fed from an input 34, via a splitter 36 that has one output coupled to a first feed pillar 30 and a second output coupled to a second feed pillar 32, via a phase delay circuit 38.

In an embodiment, phase delay circuit 38 the fields applied to feed pillars 30, 32 to mutually equal phase. This has the effect of making the radiation pattern from the feed is symmetric about the normal to the second row of pillars 182. In a further embodiment the distance between the rows of pillars 180, 182 is selected so that the frequency used for transmission or reception the waveguide formed with the rows of pillars 180, 182 is closely above the cut off frequency of the wave guide. This concentrates leaking radiation near the normal to the second row of pillars 182. Combining this with equal phase fields at feed pillars 30, 32 realizes a broadside radiation pattern from the feed.

In another embodiment, phase delay circuit 38 sets a phase relation between the fields applied to feed pillars 30, 32 in correspondence with the phase delay due to wave propagation through the waveguide formed by conductive surfaces 12, 14 and the rows of pillars. For example, when the feed pillars 30, 32 are at a half wavelength distance, the phase delay may be 180 degrees. This may be used to suppress undesired propagation modes. However, other distances may be used. Alternatively, the phase delay may be set to a value so that the phase at one feed pillar is opposite to the phase of a wave of an undesirable reaching the one feed pillar from the other feed pillar. In a further embodiment more than two feed pillars may be used in a further row between rows of pillars 180, 182. In an embodiment these feed pillars are fed with signals that have phase relations corresponding to the speed of propagation in the waveguide. This may be used to suppress undesired propagation modes and/or to extend the range of positions along second row of pillars 182 over which waves are emitted with significant strength.

In another embodiment, a row of feed pillars 30, 32 that are fed with fields in a selected phase relation may be used without the walls formed by the rows of pillars 180, 182, or with only one of such rows at the back of the row of feed pillars, opposite to the direction of radiation. In another embodiment a row of pillars, e.g. arranged along a straight line, may be used, in which only part of the pillars are feed pillars, in order to excite a leaky travelling wave along this row of pillars.

Figure 4:
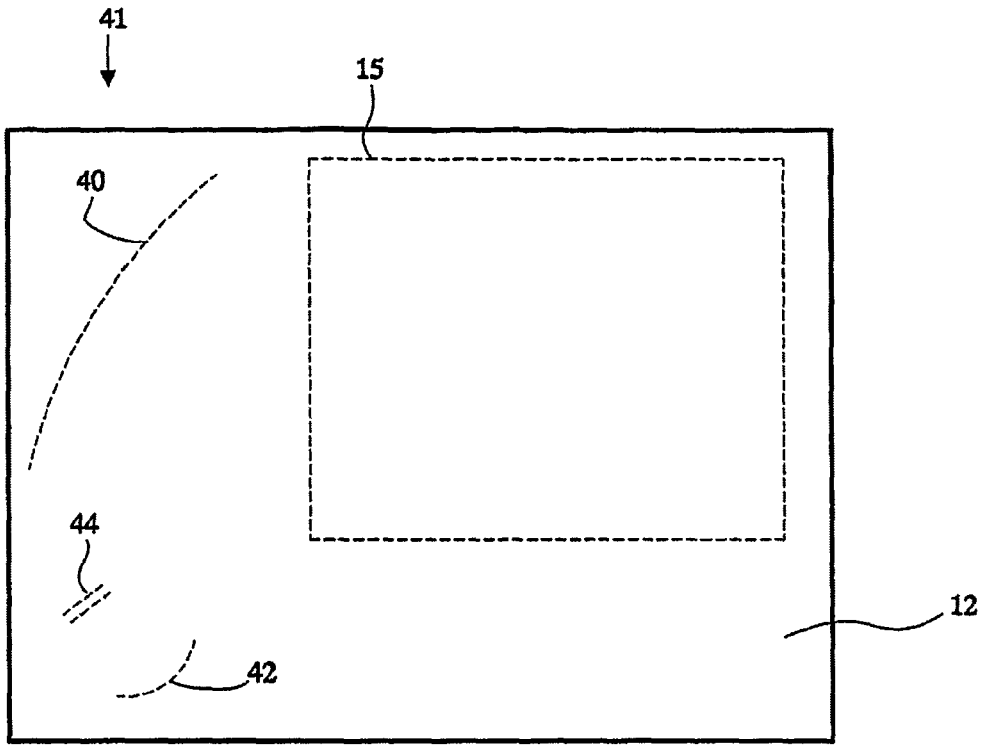
FIG. 4 shows an antenna having a feed structure with a reflector

FIG. 4 shows an antenna having a feed structure with a reflector 41 comprising sets of conductive pillars 40, 42 electrically connected between the first and second conductive surface. In the example of FIG. 4 the first and second sets of conductive pillars 40, 42 are arranged along a parabolic curve and a Gregorian elliptical sub reflector curve respectively, mutually arranged as a primary and secondary reflector, to focus plane waves from array 15 of slots 16 substantially onto a point on feed source 44. However, number and shape of curves may be used that has a focussing reflector effect. Instead of two curves a single curve with focussing effect may be used or more than two curves may be used. In the art it is known to design cylindrical reflector shapes that substantially focus a plane wave onto a focus line. The cross-section of any such shape may be used to select the curve or curves wherein pillars 40, 42 are arranged. The distance between the pillars 40, 42 along the curves is preferably made so small that at the operational wavelength little or no radiation (e.g. less than ten percent) leaks through.

In transmission operation waves are generated between the conductive surfaces 12, 14 from feed source 44, which may have the structure of the feed structure described in the preceding figures. The reflector converts these wave substantially to a plane wave that travels between conductive surfaces 12, 14 in the array 15 of slots 16, giving rise to a directional radiation pattern.

As may be noted the manufacture of reflector 11 is compatible with that of the remainder of the antenna. The pillars of the reflector can be made in the same way as pillars 180, 182 of the feed structure of the preceding figures.

Figure 5:
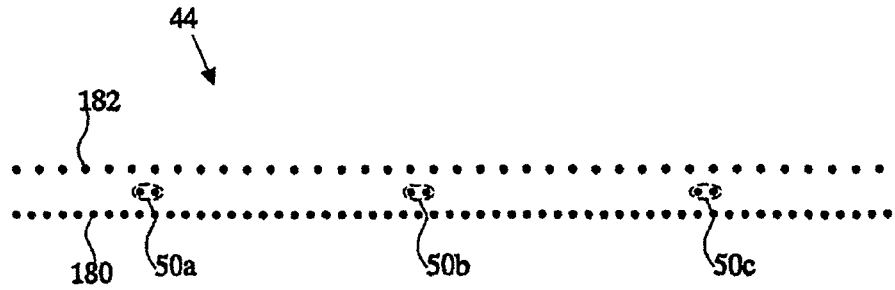
FIG. 5 shows a feed source

FIG. 5 shows a feed source 44 that may be used in the antenna of FIG. 4 to realize multiple beams. Herein a plurality of sets of feed pillars 50*a-c* is provided between the first and second row of pillars 180, 182. Each set of feed pillars may consist of one feed pillar or of a plurality of feed pillars. The distance between different sets of feed pillars 50*a-c* is selected larger than a half value decay distance of waves excited by any individual set 50*a-c*. Sources of different signals may be coupled to respective ones of the sets of feed pillars 50*a-c*.

In operation different sets of feed pillars 50*a-c* makes feed source function as a set of local sources of directed waves at different positions along the second row of pillars 182. Reflector 41 converts the waves from the different local sources into substantially planar waves with different directions of propagation in the array 15 of slots 16. Leakage from the array 15 of slots 16 in turn results in beam in different directions in the far field away from the antenna. Reciprocally in reception waves from different far field direction couple into array 15 of slots 16 to form waves with different directions between conductive surfaces 12, 14. Reflector 11 substantially focuses waves from these different directions onto different positions along the second row of pillars 182, where the waves are coupled into the waveguide formed by the conductive surfaces and the rows of pillars and picked up in the respective sets of feed pillars 50*a-c*.

It should be appreciated that many variations are possible in the exemplary embodiments. For example, the first row of pillars 180 and/or the curves of pillars in the reflectors could be replaced by continuous walls connecting the first and second conductive surface 12, 14 through dielectric sheet 10. Use of pillars has the advantage that no elongated cuts in dielectric sheet 10 are needed. Of course such a cut is not needed for example if a first row of pillars 180 at the edge of the sheet is replaced by a continuous wall.

Instead of a single layer dielectric sheet 10 a sheet with a stack of layers may be used, for example adapted to set propagation properties of waves between conductive surfaces 12, 14. Alternatively, dielectric sheet 10 may be replaced by a vacuum, or a space containing a fluid, such as air, or by injected foam. Additional layers may be provided on top of first conductive surface 12 opposite dielectric sheet 10. Such layers may contain dielectric material, magnetizable material, further slotted conductive surfaces etc. Also, although an embodiment with flat planar surfaces 12, 14 has been shown, alternatively a structure with bent conductive surfaces 12, 14 may be used.

The direction of substantially planar waves (i.e. the direction perpendicular to substantially straight lines between conductive surfaces 12, 14 along which the wave has the same phase) determines the angle of a projection of an antenna lobe in a plane of the conductive surfaces 12, 14. The angle between the main lobe and an axis perpendicular to the conductive surfaces is determined by the speed of propagation of the waves between the conductive surfaces and the distance between the slots 16. Near resonance, the speed of propagation may depend strongly on wave frequency. This can be used to create beams at different angles axis perpendicular to the conductive surfaces. The transmission and/or reception frequency for transmitting and/or receiving information is selected dependent on the required angle relative to the perpendicular axis, a frequency being selected at which a propagation speed between conductive surfaces 12, 14 adjacent array 15 of slots 16 results in a main lobe at the desired angle. In an embodiment a multi-beam antenna is realized using a signal generator that generates carriers at a plurality of frequencies, that result in different propagation speeds between conductive surfaces 12, 14 adjacent array 15 of slots 16, and by feeding the combination of the carriers to a common sets of feed pillars 50*a* from the signal generator. The signal generator may be configured modulate information on the carriers. Frequency differences may be selected that result in main beam directions of the antenna pattern that are at least five degrees apart. Similarly a multi-beam reception antenna may be realized by substituting a receiver for the signal generator or adding a receiver to the signal generator.

In a further embodiment, this frequency controlled direction setting is combined with feed pillars to which fields are applied in-phase, as described in the context of FIGS. 3*a,b*. The in-phase application realizes a radiation pattern concentrated around the normal to the wall formed by the row of pillars, with an average main direction that is independent of frequency. Thus, the use of frequency to redirect the main lobe relative to the normal to the array of slots need not affect the component of the direction of the main lobe in a plane of the array of slots.

The invention claimed is:

1. A leaky wave antenna, comprising a first electrically conductive surface and a second electrically conductive surface in parallel to each other, the first electrically conductive surface comprising a two-dimensional array of slots;

a feed structure comprising a waveguide structure comprising first and second, at least partially electrically conductive walls in parallel with each other, each wall electrically connecting the first and second electrically conductive surfaces, the second wall being located between the first wall and a region between the first and second electrically conductive surfaces adjacent to at least part of the array of slots, each of the first and second walls comprising a respective series of electrically conductive pillars arranged along a length of each of the first and second walls, the series of pillars of the first wall having a first uniform spacing between each adjacent pillar, the series of pillars of the second wall having a second uniform spacing between each adjacent pillar allowing leaky wave coupling between a wave that travels through the waveguide and waves travelling to or from said region, the second spacing being larger than the first spacing, said waveguide structure being configured to direct an electromagnetic wave pattern travelling between the first and second walls towards the region between the first and second electrically conductive surfaces adjacent to at least part of the array of slots, and/or to collect waves travelling between the first and second electrically conductive surfaces from said region.

2. A leaky wave antenna according to claim 1 further comprising a electrically conductive feed pillar located between the walls and extending in a direction between the first and second surface and electrically connected to one of the first and second surfaces and to an input and/or output terminal of the antenna.

3. A leaky wave antenna according to claim 2 further comprising a plurality of electrically conductive feed pillars, each located between the first and second walls and extending in a direction between the first and second surfaces, and electrically connected to one of the first and second surfaces.

4. A leaky wave antenna according to claim 3, further comprising a feed circuit coupled to the plurality of feed pillars and configured to supply versions of a transmission signal with respective phase delays to the feed pillars and/or collect reception signals from the feed pillars after applying respective phase delays to the transmission signal.

5. A leaky wave antenna according to claim 3, wherein each of the plurality of feed pillars is coupled to a respective input and/or output terminal of the antenna.

6. A leaky wave antenna according to claim 1, wherein the feed structure comprises a feed source and a reflector located to direct waves between the feed source and said region, the reflector comprising a curved third wall electrically coupling the first electrically conductive surface to the second electrically conductive surface.

7. A leaky wave antenna according to claim 6, wherein the curved third wall comprises a series of electrically conductive pillars arranged along a trajectory of the curved third wall, each electrically conductive pillar of the curved third wall electrically coupling the first electrically conductive surface to the second electrically conductive surface.

8. A leaky wave antenna according to claim 6, wherein the curved third wall has a parabolic trajectory.

9. A leaky wave antenna according to claim 6, wherein the feed source is configured to emit or receive independent waves between the first and second electrically conductive surfaces at a plurality of positions, the reflector being shaped to redirect the waves from said positions in mutually different directions through the array of slots and/or to redirect waves with different directions from the array of slots to respective ones of the positions.

10. A leaky wave antenna according to claim 6, wherein the feed structure comprises a plurality of curved walls, each of the curved walls electrically coupling the first electrically conductive surface to the second electrically conductive surface.

11. A leaky wave antenna according to claim 6, further comprising a signal generator and/or receiver configured to generate and/or receive a signal and further configured to select a frequency of the signal dependent on an antenna pattern direction required for the signal.

12. A leaky wave antenna according to claim 6, comprising a signal generator and/or receiver configured to generate and/or receive a plurality of signals, with mutually different frequencies, which result in different wave propagations speeds between the first and second electrically conductive surfaces adjacent the array of slots, corresponding to far field antenna lobes in mutually different directions from the array of slots.

13. A leaky wave antenna according to claim 1, comprising a dielectric layer, wherein the first and second electrically conductive surfaces are attached to mutually opposite sides of the dielectric layer, the electrically conductive pillars extending through respective openings in the dielectric layer.

14. A leaky wave antenna comprising a first electrically conductive surface and a second electrically conductive surface in parallel to each other, the first electrically conductive surface comprising a two-dimensional array of slots, the array of slots being disposed in two parts;

a feed structure located between the two parts and comprising a waveguide structure comprising first and second at least partially electrically conductive walls in parallel with each other, each wall electrically connecting the first and second electrically conductive surfaces and configured to direct an electromagnetic wave pattern travelling between the first and second electrically conductive surfaces towards a region between the first and second electrically conductive surfaces adjacent to respective parts of the array of slots, and/or to collect waves travelling between the first and second electrically conductive surfaces from said region.

15. A leaky wave antenna according to claim 14, wherein both walls have openings for allowing leaky wave coupling between a wave that travels through the waveguide and waves travelling to or from said region.

16. A leaky wave antenna according to claim 15, wherein the walls comprise a respective series of electrically conductive pillars arranged along a trajectory of each respective wall, wherein each series of pillars electrically couples the first and second electrically conductive surface, and successive ones of the pillars in each series of pillars have a mutual spacing allowing said leaky wave coupling.

17. A leaky wave antenna according to 14 further comprising an electrically conductive feed pillar located between the walls and extending in a direction between the first and second surfaces, and electrically connected to one of the first and second surfaces and to an input and/or output terminal of the antenna.

18. A leaky wave antenna according to claim 17, wherein the first and second walls are arranged to form a rectangular waveguide structure.

19. A leaky wave antenna according to claim 14 further comprising a plurality of electrically conductive feed pillars, wherein each of the feed pillars is located between the walls, extends in a direction between the first and second surfaces, and is electrically connected to one of the first and second surfaces.

20. A leaky wave antenna according to claim 19, further comprising a feed circuit coupled to the plurality of feed pillars and configured to supply versions of a transmission signal with respective phase delays to the feed pillars and/or to collect reception signals from the plurality of feed pillars after applying respective phase delays to the transmission signal.

21. A leaky wave antenna according to claim 19, wherein each of the plurality of feed pillars is coupled to a respective input and/or output terminal of the antenna.

* * * * *

UNITED STATES PATENT AND TRADEMARK OFFICE

CERTIFICATE OF CORRECTION

PATENT NO. : 8,421,698 B2
APPLICATION NO. : 12/669982
DATED : April 16, 2013
INVENTOR(S) : Andrea Neto et al.

It is certified that error appears in the above-identified patent and that said Letters Patent is hereby corrected as shown below:

On the Title page, Item (73), Assignee, delete "Nederlandse Organisatie voor toegepastnatuurwetenschappelijk onderzoek TNO" and insert --Nederlandse Organisatie voor toegepast-natuurwetenschappelijk onderzoek TNO--.

Signed and Sealed this
Second Day of July, 2013

Teresa Stanek Rea
*Acting Director of the United States Patent and Trademark Office*